US006808259B2

(12) United States Patent
Rasmussen et al.

(10) Patent No.: US 6,808,259 B2
(45) Date of Patent: Oct. 26, 2004

(54) CONTROLLING MEDIA CURL IN PRINT-ZONE

(75) Inventors: Steve O. Rasmussen, Vancouver, WA (US); Robert M. Yraceburu, Camas, WA (US); Steven P. Downing, Camas, WA (US); Stuart D. Spencer, Vancouver, WA (US); Jason S. Belbey, Vancouver, WA (US); Vance M. Stephens, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/066,111

(22) Filed: Jan. 31, 2002

(65) Prior Publication Data

US 2003/0142190 A1 Jul. 31, 2003

(51) Int. Cl.[7] ..... B41J 2/01; B41F 13/24; B41L 47/14; B65H 29/70; G03G 15/00

(52) U.S. Cl. ..... 347/104; 101/232; 101/477; 400/642; 400/656; 400/645; 400/645.1; 271/188; 399/406

(58) Field of Search ..... 347/104; 101/232, 101/477; 400/642, 656, 645, 645.1; 271/188; 399/406

(56) References Cited

U.S. PATENT DOCUMENTS

| | | | | | |
|---|---|---|---|---|---|
| 4,437,780 | A | * | 3/1984 | Weber et al. | 400/642 |
| 4,463,361 | A | * | 7/1984 | Koumura et al. | 346/134 |
| 4,611,902 | A | * | 9/1986 | Schon | 399/328 |
| 4,888,602 | A | * | 12/1989 | Watanabe et al. | 346/134 |
| 5,098,211 | A | * | 3/1992 | Murakami et al. | 400/645 |
| 5,321,467 | A | * | 6/1994 | Tanaka et al. | 399/2 |
| 5,356,229 | A | * | 10/1994 | Hickman et al. | 400/642 |
| 5,367,934 | A | * | 11/1994 | MacNiel | 83/425.2 |
| 5,555,083 | A | * | 9/1996 | Kuo et al. | 399/406 |
| 5,625,398 | A | * | 4/1997 | Milkovits et al. | 347/104 |
| 5,646,667 | A | * | 7/1997 | Broder et al. | 347/104 |
| 5,697,298 | A | * | 12/1997 | Greive et al. | 101/232 |
| 5,927,198 | A | * | 7/1999 | Tada | 101/232 |
| 6,024,019 | A | * | 2/2000 | Williams et al. | 101/463.1 |
| 6,139,140 | A | * | 10/2000 | Rasmussen et al. | 347/104 |
| 6,164,204 | A | * | 12/2000 | Kawada et al. | 101/415.1 |
| 6,183,152 | B1 | * | 2/2001 | Kumai et al. | 400/611 |
| 6,237,485 | B1 | * | 5/2001 | Fukai | 101/118 |
| 6,276,274 | B1 | * | 8/2001 | Hoffman et al. | 101/474 |
| 6,682,190 | B2 | * | 1/2004 | Rasmussen | 347/104 |

FOREIGN PATENT DOCUMENTS

JP 361206678 A * 3/1985

* cited by examiner

*Primary Examiner*—Lamson Nguyen
*Assistant Examiner*—Leonard Liang

(57) ABSTRACT

In an inkjet printing apparatus an inkjet printhead has a plurality of inkjet nozzles which eject ink onto media located within a print-zone. A drive shaft is located upstream of the printhead and is incrementally rotated to advance the media. The drive shaft has a longitudinal axis, a first radius over a central length and a second radius less than the first radius at a first recess and a second recess, each said recess being peripheral to the central length. A plurality of pinch devices stabilize the media against the drive shaft. A first guide is aligned with the first recess and is spaced from an axis of the drive shaft by a first distance which is less than the first radius. A second guide is aligned with the second recess and is spaced from the axis by a second distance less than the first radius.

21 Claims, 5 Drawing Sheets

FIG. 2
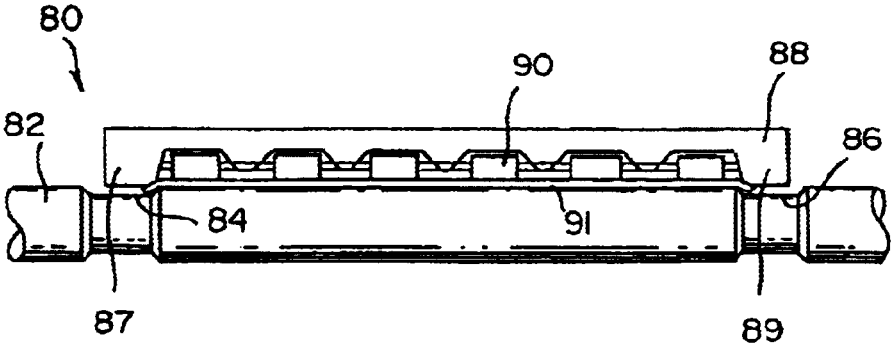
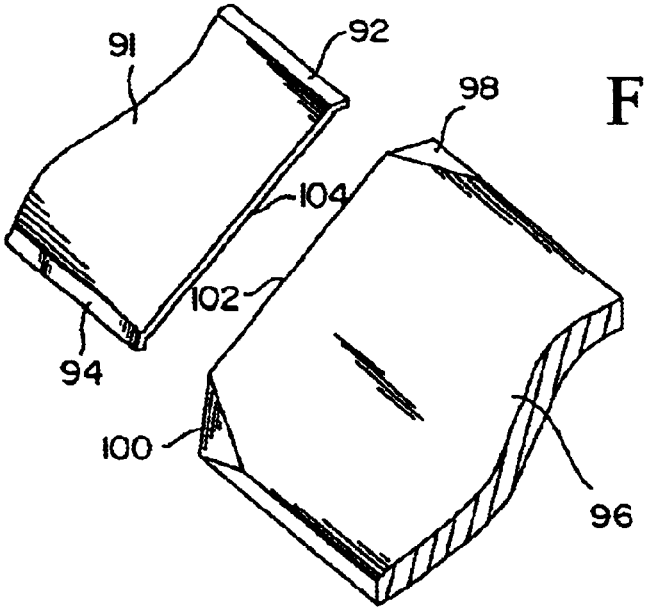
FIG. 3
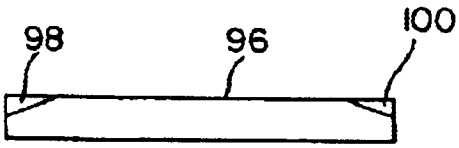
FIG. 4
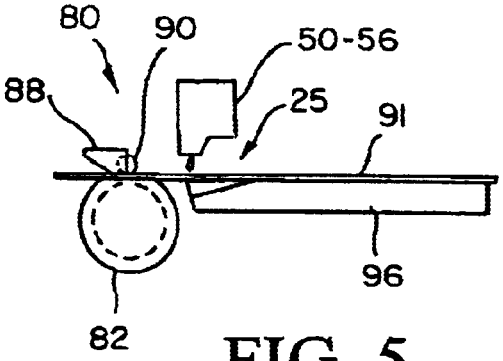
FIG. 5

FIG. 6
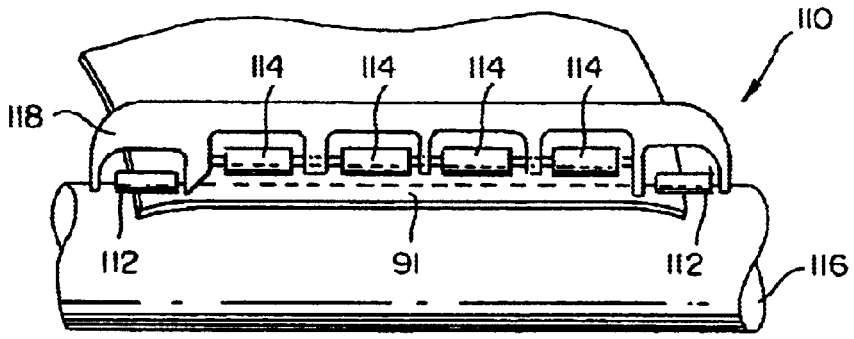
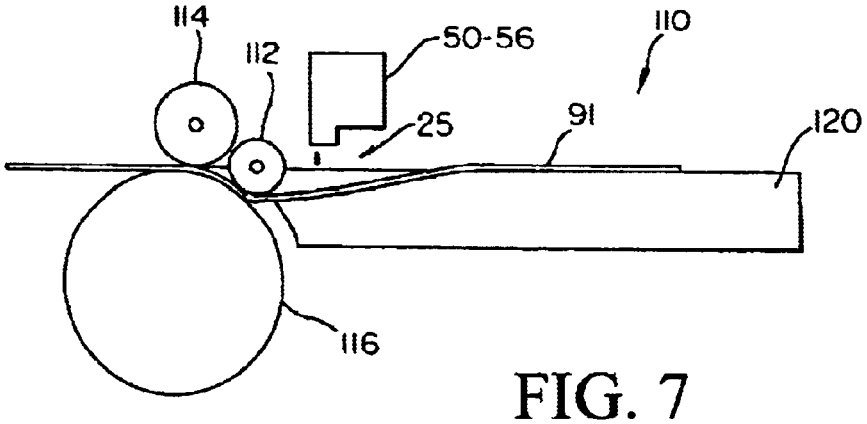
FIG. 7

FIG. 8
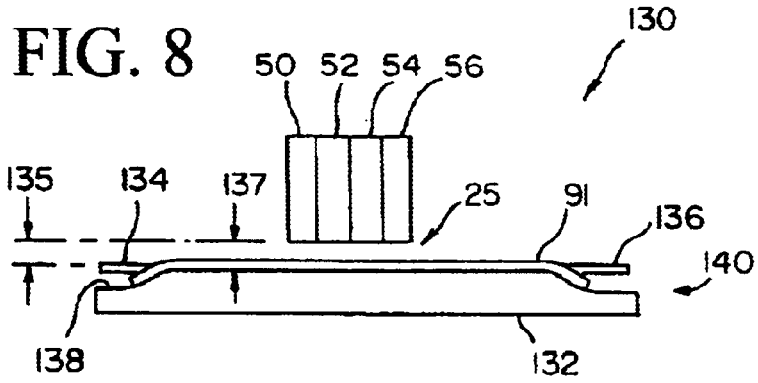
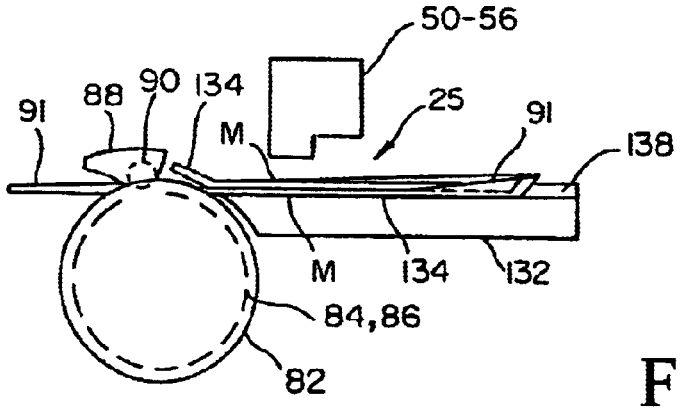
FIG. 9
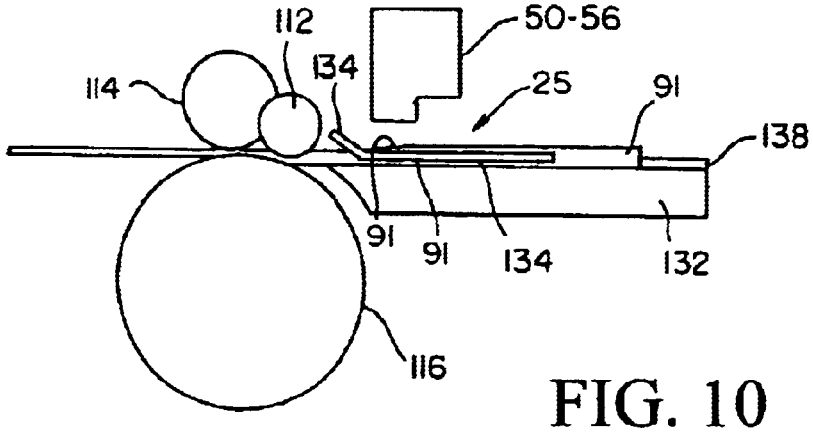
FIG. 10

FIG. 11
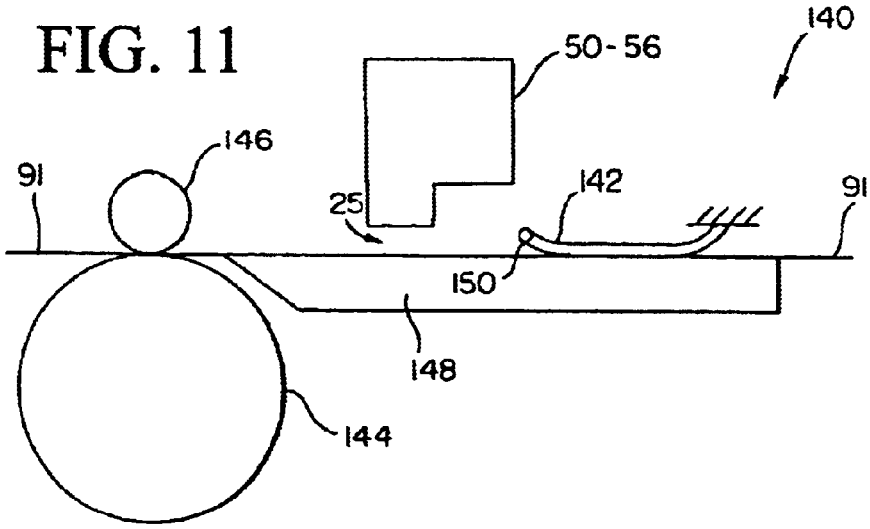
FIG. 12
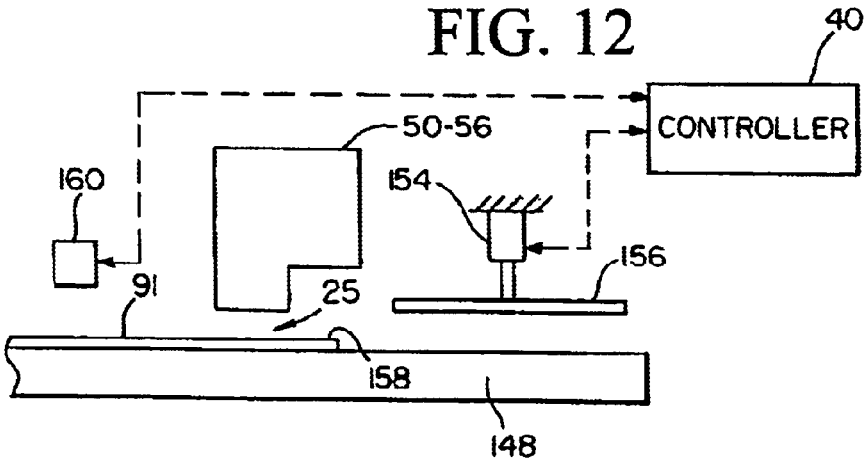
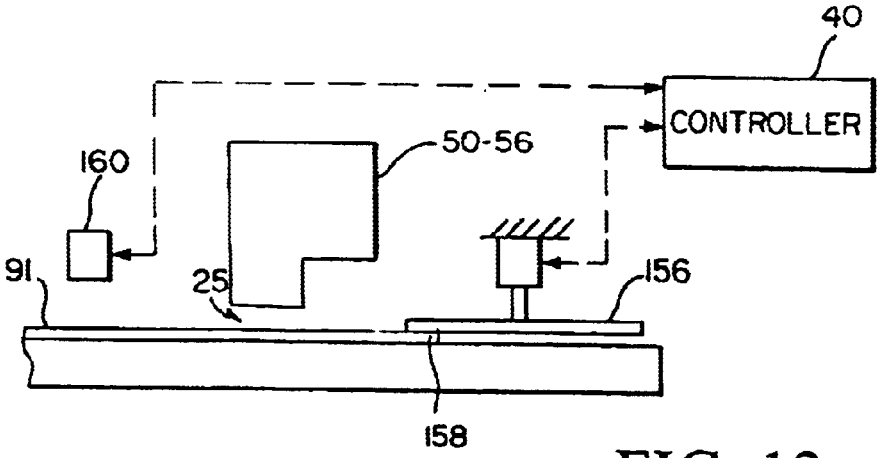
FIG. 13

CONTROLLING MEDIA CURL IN PRINT-ZONE

BACKGROUND OF THE INVENTION

This invention relates generally to media handling for inkjet printing systems.

An inkjet printing mechanism is a type of non-impact printing device which forms characters, symbols, graphics or other images by controllably spraying drops of ink. The mechanism typically includes a cartridge, often called a "pen," which houses a printhead. There are various forms of inkjet printheads, known to those skilled in the art, including, for example, thermal inkjet printheads and piezoelectric printheads. The printhead has very small nozzles through which the ink drops are ejected. To print an image the pen is propelled back and forth across a media sheet, while the ink drops are ejected from the printhead in a controlled pattern. Other inkjet printing mechanisms employ a stationary printhead which spans the entire print-zone, and hence are known as a page-wide-array printhead or a print bar. Inkjet printing mechanisms may be employed in a variety of printing systems, such as printers, plotters, scanners, facsimile machines, copiers, and the like.

Typically inkjet printing systems include a roller for feeding a media sheet along a media path. One challenge arising from curling the media sheet around the roller is that the lead or trailing edges of the media sheet may retain some of the curl. As a result the media sheet may curl within the print-zone. Such curling may adversely affect print quality. It is particularly undesirable for the media sheet to curl into contact with the printhead where can damage occur to the media, the printed image, the printhead or the print system. One solution is to increase the spacing between the pen and the media to reduce the likelihood of printhead contact. However, with a varying "pen to paper" spacing ("PPS") along the media sheet, print quality is reduced. It is preferred that "pen to paper" spacing remain constant along the various portions of the media sheet passing through the print-zone.

SUMMARY OF THE INVENTION

An inkjet printing apparatus which moves print media along a media path, includes an inkjet printhead, a drive shaft, pinch devices, and first and second guides. The inkjet printhead has a plurality of inkjet nozzles which eject ink onto a portion of the media located within a print-zone. The drive shaft is located upstream of the printhead and is incrementally rotated to advance the media. The drive shaft has a longitudinal axis, a first radius over a central length and a second radius less than the first radius at a first recess and a second recess, each said recess being peripheral to the central length. A plurality of pinch devices stabilize the media against the drive shaft. The first guide is aligned with the first recess and is spaced from an axis of the drive shaft by a first distance which is less than the first radius. The second guide is aligned with the second recess and is spaced from the axis by a second distance less than the first radius.

BRIEF DESCRIPTION OF THE DRAWINGS

FIG. 2 is a planar diagram of an incrementally-stepped, continuous surface drive shaft with pinch rollers and media guide of the media handling subsystem;

FIG. 3 is a perspective view of a media sheet and support platen used in combination with the drive shaft of FIG. 2;

FIG. 4 is a planar front view of the platen of FIG. 3;

FIG. 5, is a planar diagram of the media handling system of one embodiment of the present invention;

FIG. 6 is a perspective diagram of an alternative drive shaft with forwardly offset pinch rollers;

FIG. 7 is a planar diagram of an alternative media handling system of another embodiment of the present invention;

FIG. 8 is a planar diagram of a platen having recessed grooves and guide shims which press media sheet edges into the grooves;

FIG. 9 is a planar diagram of the platen and guide shims of FIG. 8 combined with the drive shaft and media guide of FIG. 2;

FIG. 10 is a planar diagram of the platen and guide shims of FIG. 8 combined with the drive shaft and pinch rollers of FIG. 6;

FIG. 11 is a planar diagram of a media handling system including a post print-zone guide shim(s);

FIG. 12 is a planar diagram of an alternative media handling system including a post print-zone guide shim(s) in a raised position; and FIG. 13 is a planar diagram of the media handling system of FIG. 12 with the post print-zone guide shim(s) in a lowered position.

DESCRIPTION OF SPECIFIC EMBODIMENTS

Figure 1:
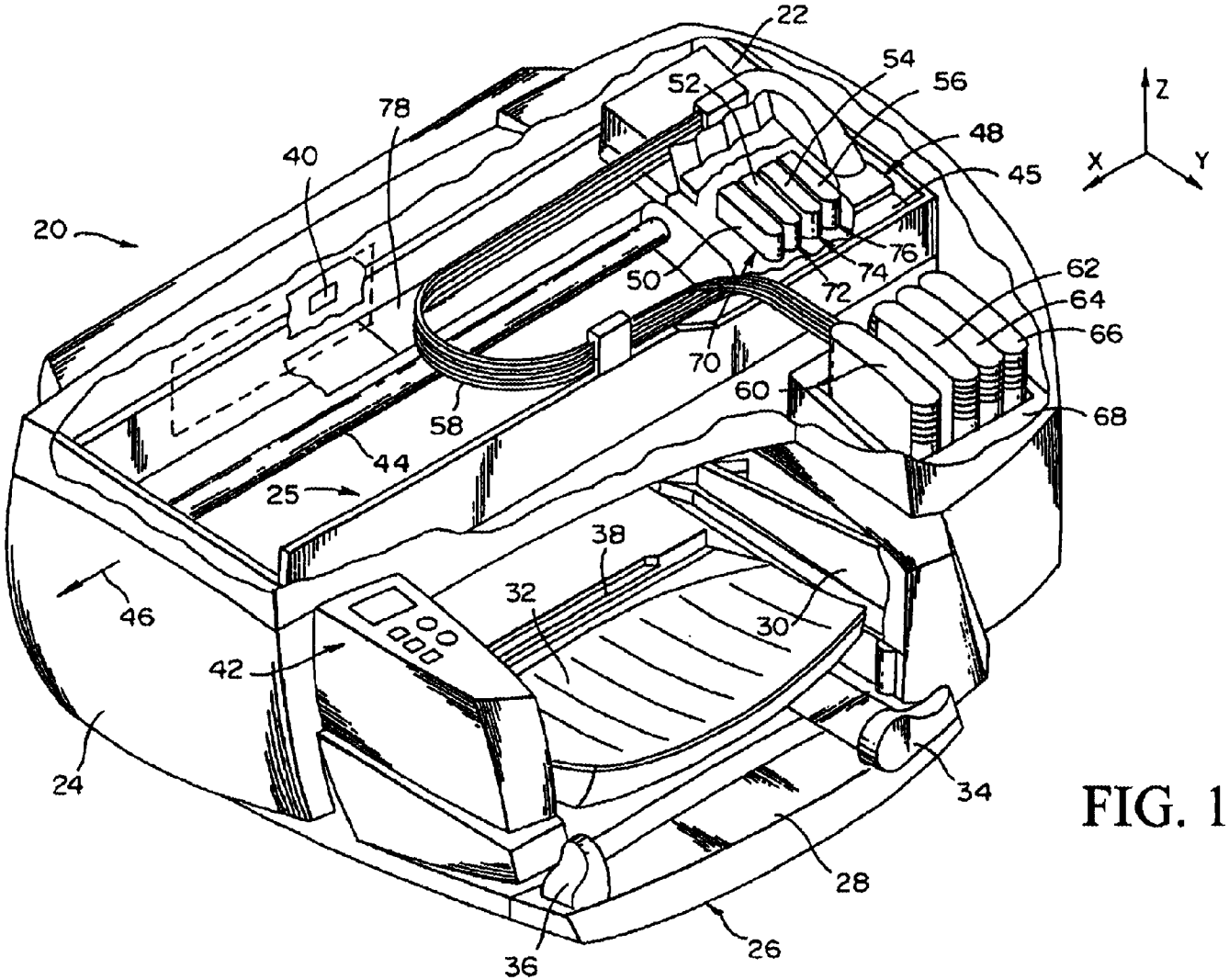
FIG. 1 is a perspective view of one form of an inkjet printing mechanism, here, an inkjet printer, including a media handling system embodiment of the present invention.

FIG. 1 illustrates an inkjet printing system, here shown as an inkjet printer 20, constructed in accordance with the present invention. Such system may be used for printing business reports, printing correspondence, and performing desktop publishing, and the like, in an industrial, office, home or other environment. A variety of inkjet printing systems are commercially available. For instance, some of the printing systems that may embody the present invention include portable printing units, copiers, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print-zone 25 by a media handling system 26. The print media may be any type of suitable sheet material, supplied in individual sheets or fed from a roll, such as paper, card-stock, transparencies, photographic paper, fabric, mylar, and the like, but for convenience, the illustrated embodiment is described using a media sheet of paper as the print medium. The media handling system 26 has a feed tray 28 for storing media sheets before printing. A series of conventional drive rollers driven by a stepper motor and drive gear assembly may be used to move the media sheet from the input supply tray 28, through the print-zone 25, and after printing, onto a pair of extended output drying wing members 30, shown in a retracted or rest position in FIG. 1. The wings 30 momentarily hold a newly printed sheet above any previously printed sheets still drying in an output tray portion 32. The wings 30 then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slidably support an off-axis inkjet pen carriage system 45 for travel back and forth across the print-zone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the print-zone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the print-zone 25, the media sheet 34 receives ink from an inkjet cartridge, such as a black ink cartridge 50 and three monochrome color ink cartridges 52, 54 and 56, shown schematically in FIG. 1. The cartridges 50–56 are also often called "pens" by those in the art. The black ink pen 50 typically contain a pigment-based ink, while the color pens 52–56 each typically contain a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the print-zone 25 along the scan axis 46. Systems which store the main ink supply at a stationary location remote from the print-zone scanning axis are called "off-axis" systems. Systems where the main ink supply is stored locally within the pen for a replaceable inkjet cartridge system are referred to as an "on-axis" system. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the print-zone 25. Although an off-axis system is illustrated, in an alternative embodiment an on axis system is implemented.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the print-zone 25 under the nozzle. The printhead resistors are selectively energized in response to firing command control signals delivered by a multi-conductor strip 78 from the controller 40 to the printhead carriage 45.

Media Handling System Overview

Several embodiments of the media handling system 26 are described with varying features for reducing media curl within the print-zone 25. Media handling system 80 of FIGS. 2–5 is directed to a drive shaft 82 having a first radius along a central length and two recesses 84, 86 peripheral to the central length with smaller diameters. A media guide 88 is aligned with the recesses to bias side edges of a media sheet into the drive shaft recesses. Such downward bias substantially reduces media lifting off the support upstream within the print-zone.

Media handling system 110 of FIG. 6 is an alternative embodiment in which pinch rollers 112 aligned with the side edges of the media sheet have a smaller diameter than other pinch rollers 114. In addition, these smaller pinch rollers are offset forward along the drive shaft 116 toward the print-zone 25. This arrangement of pinch rollers 112, 114 biases the media side edges down. Such downward bias substantially reduces media lifting off the support upstream within the print-zone.

Media Handling System 130 of FIG. 8 includes an additional or alternative feature in which the media sheet is received under a pair of guide shims upon exiting the drive shaft. The guide shims extend along the media path from a position before the print-zone 25, then even with the print-zone 25, and to a point beyond the print-zone 25. An underlying platen includes recessed portions aligned with the guide shims allowing the guide shim height to be even with or below the height of the media sheet on the non-recessed portion of the platen. The guide shims hold the media flat within the print-zone to avoid media curling within the print-zone. In some embodiments, the recessed drive shaft of FIG. 2 is included, in which case the drive shaft recesses are aligned with the platen recessed portions. In other embodiments, the offset outer pinch rollers 112 of FIG. 6 are included, in which case, the offset pinch rollers are aligned with the recessed portions of the platen.

Media handling system 140 of FIG. 11 includes still another additional or alternative feature in which the media sheet is received under a guide shim located along the media path after the print-zone. The guide shim is located near the print-zone capturing the lead edge to prevent curling of the media sheet within the print-zone. In various embodiments the post print-zone guide shim is combined with one or more of the other media handling system features described above with regard to FIGS. 2–4. Additional detail of the media handling systems of FIGS. 2–4 are described below.

Media Handling System—Media Guide Aligned with Drive Shaft Recess

Referring to FIG. 2, the media handling system includes a drive shaft 82 having a first radius along a central length and two recesses 84, 86 peripheral to the central length having a smaller radii than the first radii. Preferably, the drive shaft has a continuous surface with the media sheet 91 held substantially flat to the surface by a set of pinch rollers 90. This is in contrast to the conventional method of having a plurality of drive rollers along a drive shaft to which pinch rollers press the media sheet. The continuous surface of the drive shaft serves to avoid bowing or at worst wrinkling of the media sheet in gaps between drive rollers.

The illustrated drive shaft recesses 84, 86 are positioned to receive the media edges of a conventional 21.6 cm by 27.9 cm (8.5 by 11 inch) media sheet and 21.0 cm by 29.7 cm (DIN size A4) media sheet. Accordingly, the recesses are spaced less than 21.0 cm apart. An exemplary spacing is 19.0 cm which leaves 1.0 to 1.3 cm of each media sheet side edge extending into the recess. The media guide 88 adds a slight bend to the media sheet edges being pressed into the recesses 84,84. Preferably, the media guide 88 is spaced from the drive shaft within each recess by a greater distance than the media sheet thickness. In doing so, the media sheet edge is pressed into the recess without being pressed to the drive shaft surface. This serves to avoid creasing the media sheet edge in conformity to the recess contour.

Preferably, the drive shaft 82 is stepped to advance the media sheet. This enables the media sheet edges to be forced down into the shaft recesses 84, 86. The media sheet portion passing over the drive shaft 82 is pressed substantially flat to the drive shaft over its entire width excluding the side edges which are slightly bowed. Such side edge bowing adds a degree of rigidity to the media sheet. The degree of rigidity depends upon the media sheet composition and the degree of bowing. Preferably, the bowing is not enough to bow the medial portion of the media sheet away from the media sheet side margins. It is desired that some degree of the imposed rigidity extend along the length of the media sheet to include the advanced portion of the media sheet within the print-zone. One skilled in the art will appreciate that the farther away from the drive shaft along the length of the media sheet, the less rigidity imposed by the media guide. Preferably, the print-zone is located within 12 cm of the drive shaft. By locating the print-zone in the vicinity of the drive shaft 82 the media sheet is able to retain a substantially flat dimension along its width while passing through the print-zone. Correspondingly, the printhead to media sheet spacing is kept substantially constant allowing for optimal print quality. More specifically, such practice avoids a detraction from print quality—uneven printhead to media sheet spacing (also referred to in the art as "pen to paper spacing" or "PPS").

Referring to FIGS. 3–5, the media handling system 80 includes a platen 96 which receives the media sheet upon exiting the drive shaft 82. The platen supports the media sheet 91 as it passes through the print-zone 25. In some embodiments the platen includes recessed contours 98, 100 at its front edge 102 for receiving the media sheet 91. As described above, the media sheet side edges 92, 94 are slightly bowed 10 upon coming off the drive shaft toward the print-zone 25. To assure that the media sheet leading edge 104 corners move onto the surface of the paten, additional clearance is provided by the platen recesses 98, 100.

Media Handling System—Pinch Rollers with Offset Outer Rollers

Referring to FIGS. 6–7, the media handling subsystem 110 includes a drive shaft 116, a plurality of pinch rollers 112, 114, a media guide 118 and a support 120. The media guide 118 is not shown in FIG. 7. Preferably, the drive shaft 116 has a continuous surface with the media sheet 91 held substantially flat to the surface by the pinch rollers 112, 114. This is in contrast to the conventional method of having a plurality of drive rollers along a drive shaft to which pinch rollers press the media sheet. The continuous surface of the drive shaft serves to avoid bowing or at worst wrinkling of the media sheet in gaps between drive rollers.

The plurality of pinch rollers include a plurality of medial pinch rollers 114 with one or more lateral pinch rollers 112 positioned laterally on each end of the set of medial pinch rollers 114. As illustrated, there is one lateral pinch roller 112 at each end of the set of pinch rollers 114. The lateral pinch rollers 112 are located so as to be in the vicinity of the media sheet side margins. The medial pinch rollers 114 each have an axis coincident with their axis of rotation. The lateral pinch rollers 112 also have a coincident axis of rotation. However, the axis of rotation of the lateral pinch rollers 112 is advanced slightly forward along the drive shaft 116 toward the print-zone 25 in comparison to the axis of rotation of the medial pinch rollers 114. Also, the lateral pinch rollers 112 have a smaller radius than the medial pinch rollers 114.

By offsetting the lateral pinch rollers 112 forward as described, the media sheet edges under the pinch rollers 112 are biased down. Along the width of the media sheet the medial sheet portion is clearing or has cleared the pinch rollers 114 while the adjacent lateral media sheet portion is under the lateral pinch rollers 112. The lateral pinch rollers are along the contour of the drive shaft 116 and thus are pressing the media side edges down relative to the adjacent media portion. Such biasing adds a degree of rigidity along the length of the media sheet 91. The degree of rigidity depends upon the media sheet composition and the degree of lateral pinch roller 112 offset. Preferably, the bias is not to be so great as to bow the medial portion of the media sheet away from the media sheet side margins. It is desired that some degree of the imposed rigidity extend along the length of the media sheet to include the advanced portion of the media sheet within the print-zone. One skilled in the art will appreciate that the farther away from the drive shaft along the length of the media sheet, the less rigidity imposed by the media guide. Preferably, the print-zone is located within 12 cm of the drive shaft. By locating the print-zone in the vicinity of the drive shaft the media sheet is able to retain a substantially flat dimension along its width while passing through the print-zone. Correspondingly, the printhead to media sheet spacing is kept substantially constant allowing for optimal print quality. More specifically, such practice avoids a detraction from print quality—uneven pen to paper spacing.

Referring to FIG. 7, the media handling system 110 includes a support 120 which receives the media sheet upon exiting the drive shaft 82. The media sheet lies on the support 120 as the media sheet advances into and through the print-zone 25. In some embodiments the support 120 is a platen such as the platen 96 described above with regard to FIG. 3. The platen 96 includes recessed contours 98, 100 at its front edge 102 for receiving the media sheet 91. To assure that the media sheet leading edge 104 corners move onto the surface of the platen, additional clearance is provided by the platen recesses 98, 100.

Guide Shim Along Platen Recess Even with Print-Zone

Media handling system 130 of FIG. 8 includes a platen support 132 and a pair of media guide shims 134, 136. The platen 132 is substantially flat and underlies the media sheet 91 as the media sheet moves into and through the print-zone 25. In one embodiment the platen 132 includes a pair of grooves 138, 140 extending longitudinally along the media path. A guide shim 134, 136 runs in each of the grooves 138, 140. The corners of the media sheet leading edge are captured between the guide shims 134, 136 and the platen 132. The media sheet side edges are located between the guide shims 134, 136 and the corresponding platen grooves 138, 140.

The guide shims 134, 136 are located over the side margins of the media sheet and preferably within the side margin limits of the media sheet. The inkjet pens 50–56 scan the width of the media sheet ejecting ink onto the media sheet 91. With the guide shims located over the margins of the media sheet, the inkjet pens 50–56 do not eject ink onto the guide shims. However, the inkjet pens may scan over the guide shims during some portion of scanning such as when moving to the service station 48. Accordingly, the portion of the guide shim even with the print-zone and immediately lateral to the print-zone preferably does not extend to the height of the printheads of the inkjet pens 50–56. FIG. 8 shows a cross section of the guide shims 134, 136, platen 132 and media sheet 91 located even with the print-zone 25. The portion of the guide shims even with the printhead extends to a height which is even with or lower than the greatest height of the portion of the media sheet being scanned. Specifically, the distance 135 as illustrated is the height difference between the printhead surface of the inkjet pens 50–56 and the upper surface of the guide shims 134, 136. The distance 137 is the height differential between the printhead surface of the pens 50–56 and the underlying media sheet 91. Preferably the height 135 is approximately the same as the height 137 or is slightly greater than 137. However, in other embodiments 135 is slightly less than 137, but is positive.

The guide shims 134, 136 add a slight degree of bending to the side margins of the media sheet 91. The bending keeps the media sheet rigid allowing for a uniform pen to paper spacing along the width of the media sheet. Toward the side margins of the media sheet, the guide shims only add a slight degree of bending so as to increase the pen to paper spacing only over the side margin (where the pen does not print). Immediately adjacent to the margins, the bend has dissipated allowing for a flat media sheet within the print-zone. In some embodiments the platen 132 is a vacuum platen which applies a suction force to the media sheet to further assist in holding the media sheet flat against the platen surface.

Referring to FIG. 9, an embodiment is shown in which the grooved platen 132 and guide shims 134, 136 are combined with the stepping drive shaft 82 and media guide 88 of FIG. 2. The media sheet M side edges are pressed into the recessed grooves 84 of the drive shaft 82 by the media guide 88. The pinch rollers 90 press the media sheet flat along the continuous surface of the drive roller 82. The corners of the media sheet leading edge are captured respectively between the media guides 134, 136. The media sheet advances along the platen 132 with the media side edges moving within the grooves 138, 140 under the media guides 134, 136. In this embodiment the bias applied to the media side edges by the media guide 88 and the guide shims 134, 136 adds rigidity along the length of the media sheet and keeps the medial portions of the media sheet away from the side margins substantially flat. In particular the portion of the media sheet within the print-zone between the media sheet side margins is kept substantially flat so as to have a uniform pen to paper spacing.

Referring to FIG. 10, an embodiment is shown in which the grooved platen 132 and guide shims 134, 136 are combined with the stepping drive shaft 116 and the pinch rollers 112, 114 of FIG. 6. The media sheet side edges are biased by the forwardly offset pinch rollers 112. The corners of the media sheet leading edge are captured respectively between the media guides 134, 136. The media sheet advances along the platen 132 with the media side edges moving within the grooves 138, 140 under the media guides 134, 136. In this embodiment the bias applied to the media side edges by the forwardly offset pinch rollers 112 and the guide shims 134, 136 adds rigidity along the length of the media sheet and keeps the medial portions of the media sheet (away from the side margins) substantially flat. In particular the portion of the media sheet within the print-zone between the media sheet side margins is kept substantially flat so as to have a uniform pen to paper spacing.

Post Print—Zone Guide Shim

For any of the embodiments illustrated in FIGS. 2–10, one or more post print-zone guide shims also may be included which are located close to the print-zone, so as to capture the leading edge of the media sheet before lead edge curling occurs. Such addition is not a necessary feature for any of such embodiments. The post print-zone guide shim(s) also may be implemented as an addition to a conventional media handling system design. Referring to FIG. 11, a media handling system 140 includes one or more guide shims 142 located downstream along the media path beyond the print-zone 25. It is preferred that each guide shim 142 be a thin strip located close to the print-zone so as to capture the leading edge of the media sheet before lead edge curling occurs. In one implementation a guide shim 142 is located toward each side edge of the media sheet. The media sheet 91 is advanced by a drive shaft 144, such as the drive shaft 82, 116 or by drive rollers driven by a conventional drive shaft. Pinch rollers 146, such as the pinch rollers 90 or 112, 114 described above press the media sheet to the drive shaft 144 or drive rollers. The media sheet 91 moves along a support 148, such as the platen 96, 120, or 132 described above. The media sheet lead edge feeds between the guide shims 142 and the platen 148. In one embodiment a lead-in 150 allows enough clearance to capture the media sheet's lead edge, even with slight curling of the lead edge. The lead edge then is guided between the shim and the platen to advance away from the print-zone 25.

In another embodiment as shown in FIGS. 12–13 a driven mechanism 154 raises or lowers the guide shim 156. After a media sheet trailing edge exits the print-zone 25, the mechanism 154 raises the guide shim 156. When the controller 40 determines that the lead edge 158 of a ensuing media sheet is just under the guide shim 156, the controller 40 signals the mechanism 154 to lower the guide shim 156. With such control of the guide shim 156, the guide shim can be located very close to the print-zone 25 with little or no lead in. The guide shim 156 can capture the lead edge of the media sheet, even with a curling edge then be lowered to hold the media sheet flat.

The media sheet position can be determined by using a sensor 160, such as a stationary or carriage-mounted sensor, to detect a lead and/or trail edge of the media sheet. In one embodiment the controller 40 receives the sensor indication, then calculates when the media sheet has advanced beyond the sensor to the guide shim 156. The incremental distance a media sheet is advanced with each step of the stepped drive shaft is known. The location of the lead edge and trail edge is determined based upon the known distance between the sensor 160 and the guide shim 156 and the known step distance of the drive shaft. One skilled in the art will appreciate that alternative methods of determining when the lead edge of the media sheet is at the guide shim 156 can be implemented, and that a variety of mechanisms can be used to raise and lower the guide shim 156 in a timely fashion.

By pressing the media sheet side regions to the platen at a location along the media path downstream of the print-zone, the media sheet is maintained flat along its length extending back into the print-zone. This enables a uniform pen to paper spacing, and accordingly a more reliable print quality.

Conclusion

The inkjet printing mechanism controls media curl to better maintain a consistent pen to paper spacing over all portions of the media sheet receiving ink. This results in uniform print quality across the media sheet.

Furthermore, better media control is maintained within the print-zone. This is particularly noteworthy for larger pens where reverse bowing solutions have not been sufficiently effective.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet printing apparatus which moves print media along a media path, comprising:

an inkjet printhead having a plurality of inkjet nozzles which eject ink onto a portion of said media located within a print-zone;

a drive shaft located upstream of the printhead and incrementally rotateable about a longitudinal axis to advance the media, the drive shaft having a first radius over a central length and a second radius less than the first radius at a first recess and a second recess, each said recess being peripheral to the central length and extending around a circumference of the drive shaft, the first and second radii being substantially perpendicular to the longitudinal axis;

a pinch devices which stabilizes the media against the drive shaft;

a first guide aligned with the first recess; and a second guide aligned with the second recess;

wherein each of the first and second guides are spaced apart from the drive roller and spaced from said longitudinal axis by a distance less than the first radius but greater than the second radius.

2. An apparatus according to claim, 1 in which the media has a leading edge with leading corners, and further comprising a support for receiving the media from the drive shaft, the support having a first clearance for receiving a central portion of the leading edge and a second clearance greater than the first clearance, for receiving the leading corners.

3. An apparatus according to claim 2, in which the support comprises a vacuum platen for holding down the media as the media passes along the media path through the print-zone.

4. An apparatus according to claim 2, further comprising a guide shim located along the media path extending even with and beyond the print-zone during printing to the media, the guide shim holding a side edge of the media to the support within a printing margin of the media.

5. An apparatus according to claim 4, further comprising a platen support having a recessed portion and a non-recessed portion, the media spanning along a non-recessed portion into the recessed portion, the guide shim aligned within the recessed portion for holding the media side edge into the recessed portion.

6. An apparatus according to claim 5, in which a top surface of the guide shim is at or below a top surface of the media, so that a printhead-to-guide-shim height differential is at least as great as a printhead-to-underlying-media spacing.

7. An apparatus according to claim 1, further comprising a guide shim located downstream of the print-zone which captures a leading edge of the media as it exits the print-zone, with the guide shim configured to reduce media curling.

8. An apparatus according to claim 7, further comprising means for lifting the guide shim as the leading edge passes under the guide shim to increase a distance between the guide shim and an underlying media support, and means for lowering the guide shim to hold the media down to decrease the distance between the guide shim and the underlying media support.

9. An apparatus according to claim 1, in which the first guide is aligned with and extends into the first recess by being spaced from said longitudinal axis by a first distance, which is less than the first radius, the first radius extending from the longitudinal axis to an outer surface of the drive shaft over a central length of the drive shaft, and in which the second guide is aligned with and extends into the second recess.

10. An inkjet printing apparatus which moves print media along a media path, comprising:

an inkjet printhead having a plurality of inkjet nozzles which eject ink onto a portion of said media located within a print-zone;

a drive shaft located upstream of the printhead and incrementally rotated about a longitudinal axis to advance the media, the drive shaft having a longitudinal axis, a first radius over a central length and a second radius less than the first radius at a first recess and a second recess, each said recess being peripheral to the central length and extending around a circumference of the drive shaft, the first and second radii being substantially perpendicular to the longitudinal axis;

a plurality of pinch devices which stabilize the media against the drive shaft;

a first guide aligned with the first recess and spaced from said longitudinal axis by a first distance which is less than the first but greater than the second radius; a second guide aligned with the second recess and spaced from said axis by a second distance less than the first but greater than the second radius;

a guide shim located along the media path extending even with and beyond the print-zone during printing to the media, the guide shim holding a side edge of the media to the support within a printing margin of the media in which a top surface of the guide shim is at or below a top surface of the media, so that a printhead-to-guide-shim height differential is at least as great as a printhead-to-underlying-media spacing; and a platen support having a recessed portion and a non-recessed portion, the media spanning along a non-recessed portion into the recessed portion, the guide shim aligned within the recessed portion for holding the media side edge into the recessed portion in which the drive shaft first recess is aligned with the recessed portion of the platen support.

11. A method of advancing print media along a media path through a print-zone of an inkjet printing apparatus, the method comprising:

receiving a center portion of the media at a central length of a drive shaft;

receiving a side edge of the media at a recess along the drive shaft, the drive shaft having a first radius along the central length and a second radius, less than the first radius, at the recess, the recess extending around a circumference of the drive shaft, the first and second radii being substantially perpendicular to a longitudinal axis about which the drive shaft rotates;

urging a side portion of the media into the recess with a first guide aligned with the recess, spaced apart from the drive roller and spaced from the longitudinal axis of the drive shaft by a first distance which is less than the first radius but greater than the second radius;

advancing the media through the print-zone; and ejecting ink onto the media when located within the print-zone.

12. The method of claim 11, wherein the advancing comprises advancing the media through the print-zone by stepping the drive shaft in increments.

13. The method of claim 12, in which the apparatus comprises a platen support and the media has a leading edge with leading corners, the method further comprising:

receiving the media from the drive shaft at the platen, wherein the platen support has a first clearance for receiving a central portion of the leading edge and a second clearance greater than the first clearance, for receiving the leading corners.

14. The method of claim 13, further comprising:

applying a suction force for holding the media to the platen as the media passes along the media path through the print-zone.

15. The method of claim 12, further comprising:

receiving a side edge of the media under a guide shim located along a portion of the media path extending before, even with and beyond the print-zone; and holding a side edge of the media with the guide shim against a platen support within a printing margin of the media.

16. The method of claim 15, in which the platen support has a recessed portion and a non-recessed portion, wherein said receiving under a guide shim comprises:

receiving a side portion of the media under the guide shim and within the recessed portion of the platen support, the media spanning the non-recessed portion into the recessed portion, the guide shim aligned within the recessed portion for holding the media side edge into the recess portion.

17. The method of claim 16, wherein said holding the side edge comprises:

holding the side edge of the media with the guide shim into the recessed portion of the support, in which a printhead to guide shim height differential is at least as great as a printhead to underlying media spacing.

18. The method of claim 12, wherein said advancing the media comprises:

advancing the media through the print-zone, wherein a leading edge of the media is captured as it exits the print-zone by a guide shim located downstream of the print-zone, the guide shim for reducing media curling.

19. The method of claim 18, further comprising:

lifting the guide shim as the leading edge passes under the guide shim to increase a distance between the guide shim and an underlying media support; and lowering the guide shim to hold the media down to decrease the distance between the guide shim and the underlying media support.

20. The method of claim 11, in which said biasing comprises biasing the side portion of the media into the recess with a first guide aligned with and extending into the first recess.

21. A method of advancing print media along a media path through a print-zone of an inkjet printing apparatus, the method comprising:

receiving a center portion of the media at a central length of a drive shaft;

receiving a side edge of the media at a recess along the drive shaft, the drive shaft having a first radius along the central length and a second radius, less than the first radius, at the recess, the recess extending around a circumference of the drive shaft, the first and second radii being substantially perpendicular to a longitudinal about which the drive shaft rotates;

biasing a side portion of the media into the recess with a first guide aligned with the first recess and spaced from a longitudinal axis of the drive shaft by a first distance which is less than the first but greater than the second radius;

advancing the media through the print-zone by stepping the drive shaft in increments;

ejecting ink onto the media when located within the print-zone;

receiving a side edge of the media under a guide shim located along a portion of the media path extending before, even with and beyond the print-zone; and holding a side edge of the media with the guide shim against a platen support within a printing margin of the media, in which the platen support has a recessed portion and a non-recessed portion, wherein said receiving under a guide shim comprises receiving a side portion of the media under the guide shim and within the recessed portion of the platen support, the media spanning the non-recessed portion into the recessed portion, the guide shim aligned within the recessed portion for holding the media side edge into the recessed portion;

wherein said receiving the side portion comprises receiving a side portion of the media under the guide shim and within the recessed portion of the platen support, wherein the drive shaft first recess is aligned with the recessed portion of the platen support.

* * * * *

UNITED STATES PATENT AND TRADEMARK OFFICE

CERTIFICATE OF CORRECTION

PATENT NO. : 6,808,259 B2
DATED : October 26, 2004
INVENTOR(S) : Steve O. Rasmussen et al.

It is certified that error appears in the above-identified patent and that said Letters Patent is hereby corrected as shown below:

Column 5,
Line 67, after “bowed” delete “10”.

Column 10,
Line 54, delete “but greater than the second”.
Line 54, after “radius” insert -- but greater than the second --.
Line 57, after “first” insert -- radius --.

Column 12,
Line 34, after “space” insert -- apart --.
Line 36, after “first” insert -- radius --.

Signed and Sealed this

Twenty-seventh Day of September, 2005

JON W. DUDAS
*Director of the United States Patent and Trademark Office*